US007467732B2

(12) United States Patent
Bougamont

(10) Patent No.: US 7,467,732 B2
(45) Date of Patent: Dec. 23, 2008

(54) PUMP LIQUID PRODUCT DISPENSER

(75) Inventor: Jean-Louis Bougamont, Eu (FR)

(73) Assignee: Rexam Dispensing Systems S.A.S (FR)

( * ) Notice: Subject to any disclaimer, the term of this patent is extended or adjusted under 35 U.S.C. 154(b) by 517 days.

(21) Appl. No.: 10/503,489

(22) PCT Filed: Feb. 5, 2003

(86) PCT No.: PCT/FR03/00344

§ 371 (c)(1),
(2), (4) Date: Aug. 10, 2005

(87) PCT Pub. No.: WO03/066235

PCT Pub. Date: Aug. 14, 2003

(65) Prior Publication Data

US 2006/0060608 A1 Mar. 23, 2006

(51) Int. Cl.
*B65D 88/54* (2006.01)

(52) U.S. Cl. ..... 222/321.9; 222/321.2; 222/321.7

(58) Field of Classification Search ..... 222/321.9, 222/385, 321.7, 341, 321.2, 321.1
See application file for complete search history.

(56) References Cited

U.S. PATENT DOCUMENTS

| | | | | | |
|---|---|---|---|---|---|
| 3,064,310 | A | * | 11/1962 | Cooprider | 264/313 |
| 3,180,534 | A | * | 4/1965 | Duda et al. | 222/321.9 |
| 3,237,571 | A | * | 3/1966 | Corsette | 417/513 |
| 3,877,616 | A | * | 4/1975 | Stevens | 222/321.9 |
| 3,877,617 | A | * | 4/1975 | Stevens | 222/321.9 |
| 4,034,900 | A | * | 7/1977 | Hafele | 222/321.9 |
| 4,524,888 | A | * | 6/1985 | Tada | 222/153.02 |
| 4,735,347 | A | * | 4/1988 | Schultz et al. | 222/321.2 |
| 6,006,955 | A | * | 12/1999 | Bouix | 222/373 |
| 6,053,371 | A | * | 4/2000 | Durliat et al. | 222/321.9 |
| 2005/0167452 | A1 | * | 8/2005 | Bougamont | 222/321.9 |

* cited by examiner

*Primary Examiner*—Frederick C. Nicolas
(74) *Attorney, Agent, or Firm*—St. Onge Steward Johnston & Reens LLC

(57) ABSTRACT

A liquid product dispenser includes a reservoir and a pump. The pump body includes an outer portion forming a sealing closure between the pump body and the reservoir nozzle and the pump body includes an annular projection extending inwards, molded in one single piece, while the piston includes an annular stop co-operating with the annular projection to define a released position of the piston.

19 Claims, 5 Drawing Sheets

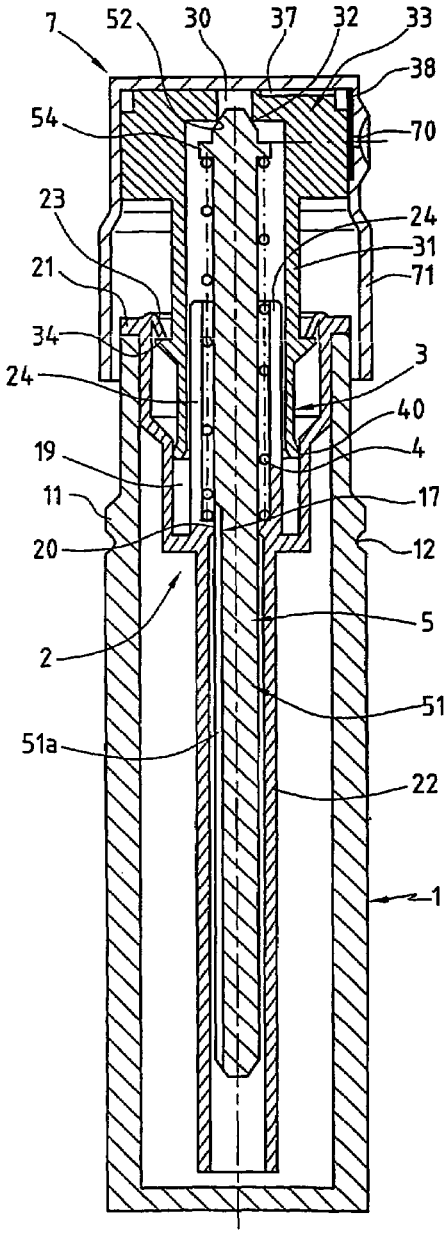
FIG.2
FIG.3
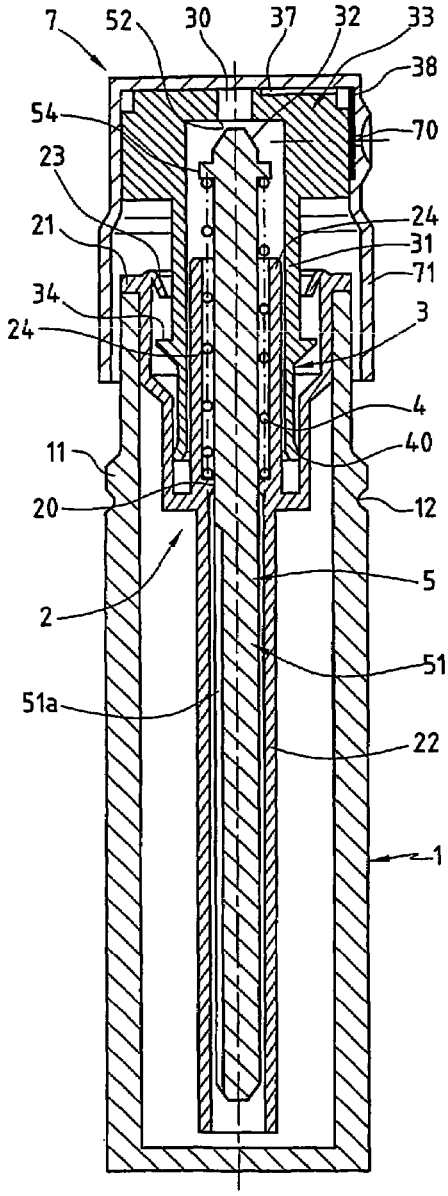
FIG.4
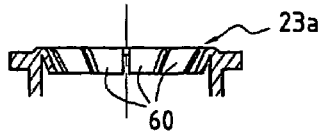

PUMP LIQUID PRODUCT DISPENSER

FIELD OF THE INVENTION

The invention discloses a liquid product dispenser and relates more particularly to the field of miniature sprays designed to contain a small quantity of a luxury product such as a perfume for example. Such sprays are principally intended for free distribution to customers to enable them to try out and evaluate the products contained therein.

BACKGROUND OF THE INVENTION

In the field of miniature sprays used for the promotion of products, and which are therefore intended to be offered to the consumer, continual efforts are made to simplify the structure of the device and to reduce manufacturing costs. To this end, manufacturers seek to reduce the number of components and to make them easier to manufacture and assemble.

A liquid product dispenser is known for example, notably a miniature spray, including a reservoir incorporating a nozzle and a pump mounted in said nozzle. This pump includes a pump body accommodating a piston, which slides in a leaktight manner inside the pump body so as to define with the latter a liquid dosing chamber, an inlet valve establishing communication between said dosing chamber and the reservoir containing of liquid to be sprayed, an outlet valve establishing communication between said dosing chamber and product dispensing means and a spring designed to move said piston to a predetermined released position wherein said dosing chamber is at its maximum volume.

Conventionally, the assembly between the pump body and the reservoir nozzle is effected by fitting an annular closure component referred to as an extender, which serves to clamp the pump body radially outward towards the inner wall of the nozzle of the bottle and which also serves as an axial stop for the piston, determining the released position (i.e. the at-rest position, before actuation) of the piston. This released position in which the dosing chamber is at its maximum volume is stabilized under the action of said spring.

SUMMARY OF THE INVENTION

A primary object of the invention is to eliminate this closure component forming a stop, referred to as the extender.

More particularly, the invention relates to a liquid product dispenser including a reservoir incorporating a nozzle and a pump mounted in said nozzle, said pump including:

- a pump body housing a piston which slides in a leaktight manner in the pump body so as to define a liquid dosing chamber in conjunction with the latter,
- an inlet valve establishing communication between said dosing chamber and the reservoir,
- an outlet valve establishing communication between said dosing chamber and dispensing means,
- a spring moving said piston to a released position in which said dosing chamber is at its maximum volume,
- characterised in that said pump body includes an outer portion forming a plug ensuring a leaktight seal between the pump body and said nozzle, and in that said pump body includes an inwardly extending annular projection, obtained by moulding, said piston incorporating an annular stop cooperating with said annular projection to define said released position, under the action of said spring.

In the case of a spray, said dispensing means are arranged as means designed to produce a spray of liquid.

According to an advantageous characteristic, said annular projection takes the form of a flexible lip. Preferably, this lip is turned inward towards the pump body. Various different ways of configuring such a flexible lip obtained by moulding with the pump body will be described below. To facilitate this assembly, the annular stop of the piston includes, on one side, a stop face cooperating with the lip and, on the other side, a tapered portion participating in the return of said lip when said piston is mounted in the pump body.

To facilitate assembly, said lip can be segmented into several circumferentially adjacent sections.

All of the pump components can be made of moulded plastic, except the spring. As will be seen below, the pump includes a minimum number of moulded parts and all of the parts are easy to manufacture by moulding and notably they are readily demouldable. The bottle can be made of glass or, preferably, moulded plastic.

In one embodiment, said inlet and outlet valves respectively include a stem and a pintle defined by a common obturator which is axially mobile inside the pump body and around which the spring is mounted. The latter is supported between the pump body and a shoulder of said common obturator. By virtue of this arrangement, the piston is moved under the action of the spring towards said released position, by means of the common obturator, which tends to hold the outlet valve closed. More precisely, one end of said obturator forms a tapered pintle which engages with the internal aperture of an outlet passage formed in the piston so as to constitute said outlet valve, and the other end of said obturator engages with an inlet tube on said pump body so as to constitute said inlet valve. The inlet tube extends beyond the dosing chamber and is immersed in the liquid contained in said reservoir. It is obtained by moulding with said pump body.

In an example, the obturator includes a part forming a stem which is designed to slide in a leaktight manner inside the inlet tube. At least one lengthwise groove is fashioned in the surface of said stem, which facilitates the passage of product in the inlet phase. All of the components are advantageously circular in cross-section and axially symmetrical.

The diameter of the circular contact zone of the internal aperture of the outlet passage against which the pintle bears is less than the internal bore diameter of the inlet tube, i.e. the external diameter of the stem.

The obturator incorporates a shoulder whereon the return spring is retained. In addition, said pump body has an annular upper flange bearing on the rim of the nozzle.

In addition, a detachable strip can be provided at the base of a pusher associated with the piston, this strip serving to hold the piston in the lower position prior to use, thereby ensuring better leaktightness of the pump (by the fact that the inlet valve is closed), also rendering the device tamper-proof and more effectively preserving the product.

In a variant, the innermost end of the obturator is configured in the form of a bell-shaped element capable of capping an end portion of the inlet tube projecting from the bottom of the dosing chamber and capable of sliding in a leaktight manner along the outer surface of this end portion. This arrangement permits easier assembly. The inlet tube can then advantageously incorporate an axial hole of very small diameter to facilitate priming of the pump by capillary action.

BRIEF DESCRIPTION OF THE DRAWINGS

The invention will be better understood and its other advantages will be made more clearly apparent in light of the following description of several embodiments of a dispenser forming a liquid product spray according to the principle of the invention, given only by way of example and in reference to the drawings in which:

FIG. 2 illustrates a view similar to that in FIG. 1, after removal of the detachable strip;

FIG. 3 illustrates a view similar to that in FIG. 2, during a spraying phase of the product;

FIG. 4 is a detail view of the upper part of the pump body, showing a variant;

DETAILED DESCRIPTION OF THE INVENTION

Figure 1:
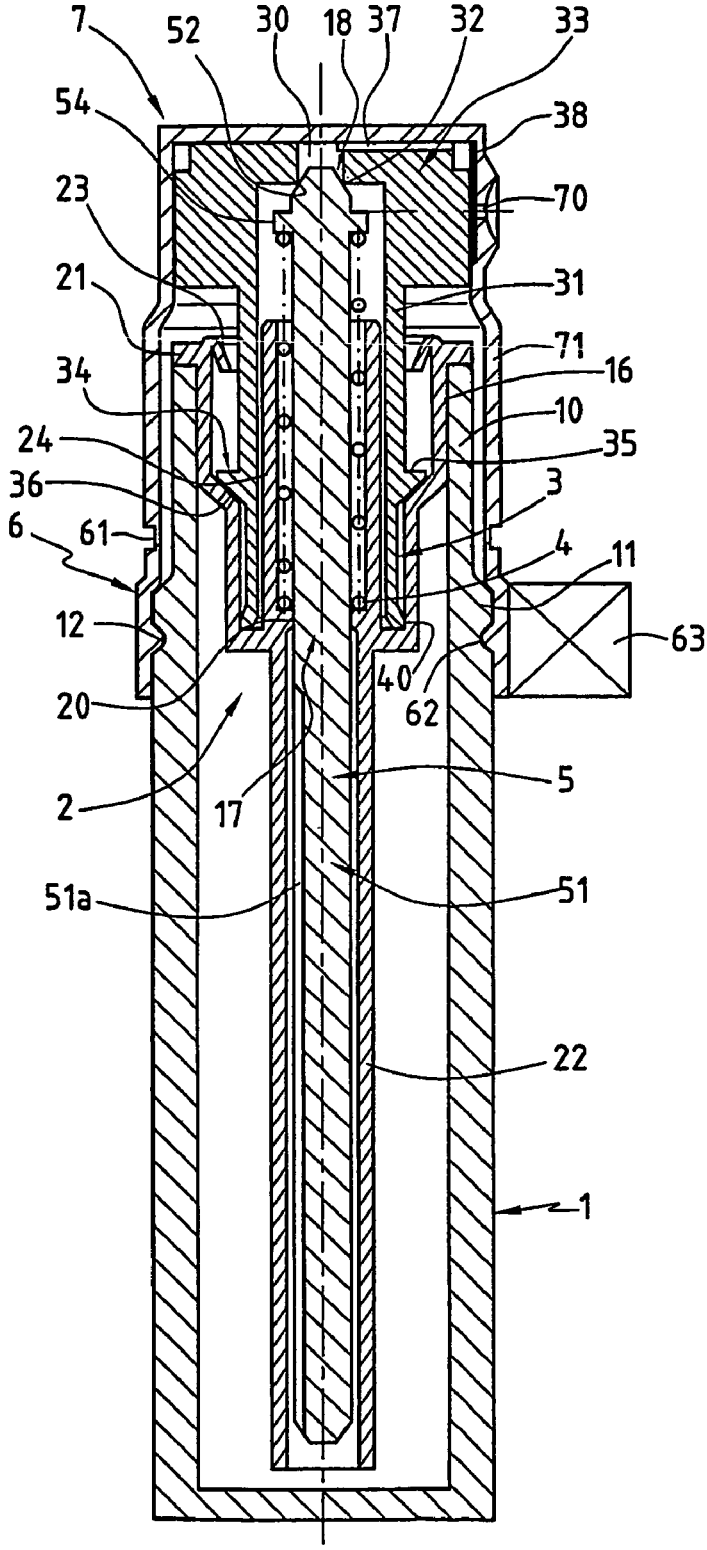
FIG. 1 illustrates a sectional view in elevation of an embodiment of a distributor forming a spray according to the invention, before its first use.

Referring more particularly to FIGS. 1 to 3, the spray shown includes a reservoir 1 equipped with a nozzle 10, in which a liquid product such as a perfume is held. In the example shown, the reservoir is cylindrical and the nozzle has an internal diameter equal to that of the reservoir. However, this nozzle can also take the form of a more or less constricted neck.

A precompression pump incorporating a pump body of cylindrical/conical shape 2 is mounted on the reservoir; said pump body is mounted in the nozzle. More precisely, the body 2 is fitted in a radially leaktight manner into the nozzle 10 in the manner of a plug. The pump body in effect includes an outer portion 16 forming a plug which in itself ensures that leaktightness is maintained between the pump body and said nozzle.

The pump body 2 has an annular upper flange 21 which bears on the rim of the nozzle 10 thereby limiting the insertion of the body into the reservoir 1 and adjusting the position of the inlet tube 22 inside this reservoir in relation to the liquid level. The inlet tube 22 is a downward extension of the pump body. It is obtained by moulding with the pump body itself.

The pump body 2 houses a cylindrical piston 3 cooperating by means of a return spring 4 with an inlet valve 17 and an outlet valve 18. With the wall of the pump body, it delineates a dosing chamber 19.

The piston 3 carries an outer tubular rod 31 extending outward by an axial outlet passage 30. The outlet passage 30 forms an extension of the dosing chamber to the outside. The internal volume of the rod 31 forms part of the dosing chamber.

The tubular rod 31 is surmounted by a dispensing head 7 forming a pushbutton which incorporates a spray aperture 70. The rod 31 is extended at its upper part by a core 33 delineating in a complementary manner with the internal wall of the head 7, on one hand, an outlet channel 37 fed by the outlet passage 30 and, on the other hand, a spray swirl system 38 into which the channel 37 emerges. The latter extends in this instance to the upper surface of the core 33. In effect, as is clearly apparent in FIGS. 1 to 3, the piston, the tubular rod 31 and the core form a single moulded component made of plastic.

The swirl system 38 is defined at the inner face of the head 7 by means of moulded cavities that are closed in contact with the core. When the core 33 is pushed fully upward inside the head 7, a leaktight connection is automatically created between the passages, the cavities forming the channels of the swirl system and the nozzle, without the need to provide indexing of the counterpart components.

For all necessary purposes, it is nonetheless possible to provide a guide rib on the head or core to engage with an axial groove so that automatic positioning is facilitated, The head 7 surmounting the core 33 has a lateral skirt 71 fitted at its lower end with a detachable peripheral strip 6, holding it locked in the lower position. It will be noted that in this position the inlet valve is closed, which greatly enhances the leaktightness of the pump before its first use. The strip 6 is separable from the head in that it is attached to the skirt 71 by a reduced-strength zone 61 capable of being broken or detached by pulling. To this end, the strip 6 is fitted with a pull tab 63.

The strip 6 has a continuous or discontinuous internal projection 62 which engages with the outer wall of the reservoir 1 by attachment in a retaining element. The latter is formed by a collar 11 on the nozzle of the reservoir 1 delineated by a reduction in thickness of the reservoir wall in proximity to the nozzle; an annular groove 12 is formed on the body of the reservoir.

The pump includes an obturator 5 common to the inlet valve 17 and the outlet valve 18 in that it forms both a stem 51 for the inlet valve and a tapered pintle 52 for the outlet valve. The common obturator 5 is axially mobile inside the pump body 2. It incorporates a shoulder 54 against which the spring 4 bears. The latter is mounted with initial precompression between the pump body and this shoulder. The pump body 2 is fitted with a coaxial inner sleeve 24 delineating, on one hand, with the sidewall of the pump body a cylindrical zone in which the piston 3 is guided and, on the other hand, with the obturator 5 a central seating for the spring 4. The pintle 52 is formed by the upper tapered end of the obturator 5. Said pintle is held against the internal aperture of the outlet passage 30. Outside a spraying period or in the inlet phase, the pintle 52 is in leaktight bearing contact against the inner aperture of the outlet passage 30.

The stem 51 is formed by the innermost cylindrical portion of the obturator 5 which is capable of sliding in a leaktight manner in the inlet tube 22 and more particularly in a short bore 20 defined in proximity to the bottom of the dosing chamber, A groove 51a is formed lengthwise over a sufficient height of the stem to facilitate passage of the product by aspiration from the reservoir 1 in the inlet phase.

Another embodiment, not shown, would entail forming an annular constriction at this same height to allow the passage of product.

The height of the obturator 5 and more particularly that of the stem is such that, when the piston is in the depressed position, it occupies nearly all of the internal volume of the suction tube 22 leaving only a small amount of play, as illustrated in FIG. 1. The head is held in the lower position by the strip 6 against the return force of the spring 4. This arrangement permits rapid priming of the pump in that the capacity of the suction tube is reduced while its specific dimensions (height and diameter) remain normal.

After removing the strip 6, as illustrated in FIG. 2, the head 7 rises immediately under the action of the spring 4 and the rising movement of the piston 3, driven by the common obturator, draws product from the reservoir 1 via the tube 22; the product enters the dosing chamber 19.

In this released position, the leaktightness of the device at the outlet valve is ensured by the pintle 32 bearing against the core 33, more particularly against the internal aperture of the passage 30. The piston 3 incorporates an annular peripheral stop 34 designed to come into contact with an annular projection in this instance taking the form of a lip 23 carried by the upper edge of the pump body 2. This annular projection forming a lip is obtained by moulding with the pump body. Thus, the annular stop 34 engages with this lip to define the released position of the piston (and therefore of the pushbutton) under the action of the spring 4. The lip 23 is a deformable lip which can be folded outward on demoulding to enable the body to be ejected from the mould during manufacture. It is subsequently turned inward. In other words, the lip 23 can be moulded substantially in the position it occupies in FIG. 1, its flexibility being sufficient for the demoulding process to take place by force by folding it outward. It then reverts practically to its normal position notably when the piston is fitted. For this purpose, it is important to note that the annular stop 34 includes a tapered portion 36 which participates in returning the lip when the piston is mounted in its final position in the pump body. In effect, the annular stop incorporates on one side a stop face 35 extending radially and cooperating with the lip 23 to define the released position, and on the other side said tapered portion 36 facilitating or confirming the repositioning of the lip on assembly.

Another method of moulding the piston and conforming the returned lip will be described below.

It is to be noted that the tubular rod 31 which extends between the core and the stop 34 has a diameter greater than the innermost part of the piston extending between said stop 34 and its free circular edge 40. The latter tapers slightly outward to define a relatively leaktight contact between the piston and the inner cylindrical wall of the pump body. In addition, the radial length of the lip 23 is greater than the radial distance separating the internal wall of the pump body 2 and the external wall of the piston, in proximity to the lip (i.e. the outer wall of said tubular rod 31). By virtue of this arrangement, the innermost part of the piston can be engaged in the central opening of the lip 23 without risk of damaging the end of the piston which will subsequently be required to ensure leaktightness in operation. Then, after fitting the annular tapered stop 34, the lip 23 assumes its final position and the assembly is made permanent by virtue of the radial length of the lip.

In the variant illustrated in FIG. 4, the lip 23*a* can be segmented at the moulding stage, i.e. made up of a plurality of circumferentially adjacent portions 60, thereby facilitating its elastic deformation when the piston is fitted.

Figure 5:
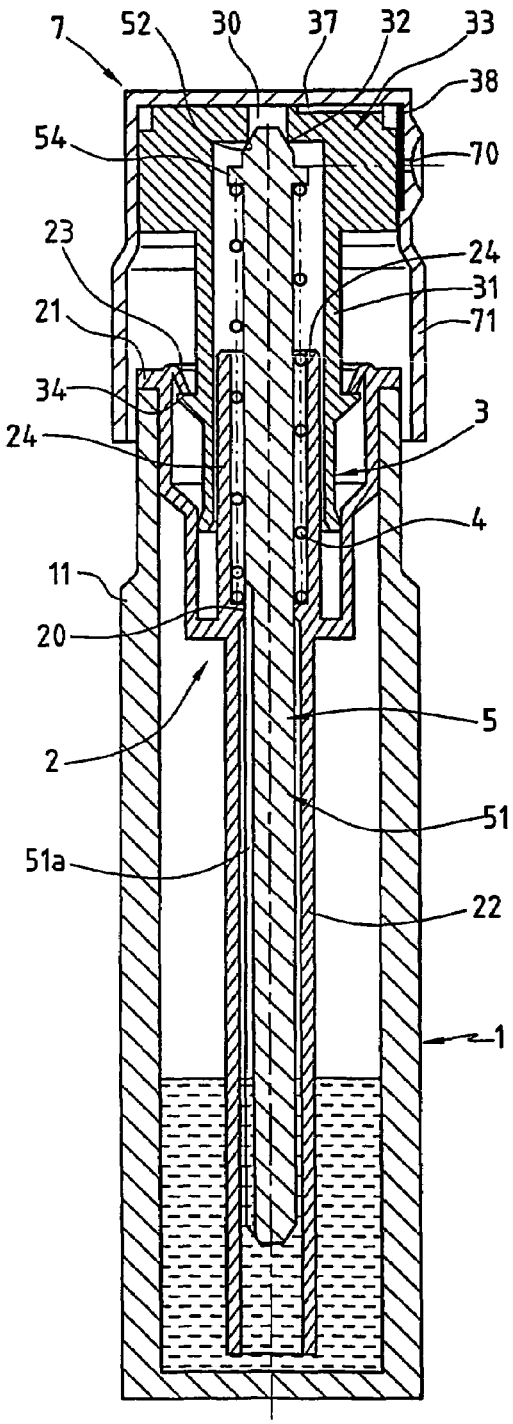
FIG. 5 is a view similar to that in FIG. 1 illustrating a variant wherein the piston is left in the released position before use.

In the embodiment shown in FIG. 1, as in FIG. 5 which differs by the position of the piston 3 before first use, the leaktightness obtained by the contact between the lower end of the piston (the circular inner edge 40) and the inner wall of the pump body 2 is a priori sufficient to prevent any escape of liquid before first use. Nevertheless, the embodiment in FIG. 1 (piston depressed before first use) exhibits enhanced leaktightness by virtue of the fact that the inlet valve 17 is closed during the entire period preceding first use.

In these two embodiments, it can be arranged so that the pump body has no vent aperture, as shown in FIGS. 1 to 3 and 5. In this case, it is preferable that the quantity of liquid placed in the reservoir on filling is notably less than the capacity of said reservoir (FIG. 5). Total leaktightness is assured but the reintroduction of air is no longer possible. The pump suction is nevertheless able to remain functional even if a slight vacuum is created inside the reservoir, as it is capable of generating a vacuum of 500 mbar in the example described. An incomplete initial fill improves the situation, In particular, if the container is filled to a third of its total capacity, the maximum vacuum at end of use will be in the order of 300 mbar and therefore insufficient to disable the pump suction which is capable of generating a vacuum of 500 mbar. By way of example, the reservoir has a capacity of 1.5 ml and therefore contains 0.5 ml of product when filled to approximately one third of its capacity. This under-filling is of significant benefit to perfume manufacturers inasmuch as it is not in their interest to freely distribute large volumes of expensive luxury products. The perfume manufacturer therefore makes a saving both on the quantity of products offered and on the cost price of the spray.

Figure 6:
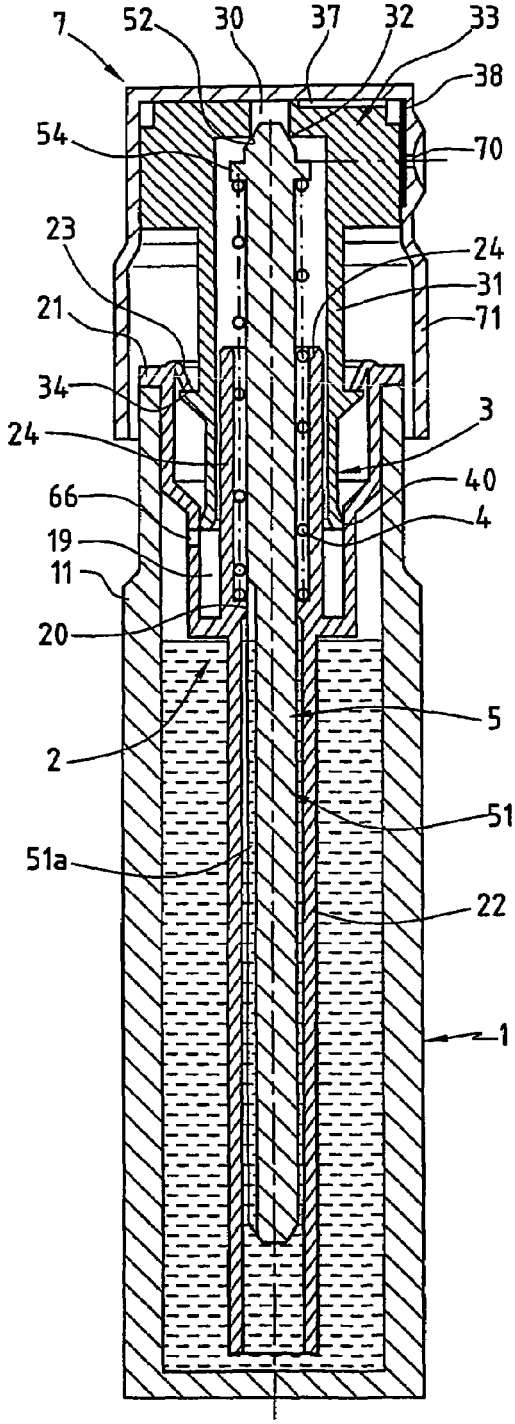
FIG. 6 illustrates a variant of FIG. 5.

However, if it is desired to have a larger quantity of liquid or to further reduce the size of the spray, it is possible to adopt the embodiment illustrated in FIG. 6. In this embodiment, which is structurally virtually identical to that in FIG. 5, a vent hole 66 is made in the wall of the pump body and emerges in the dosing chamber 19 in immediate proximity to the edge 40 of piston when the latter is in the released position. In this embodiment, the position of the piston before first use is said released position, as shown, so that leaktightness is assured at the edge 40 of the piston in leaktight friction contact with the inner wall of the pump body. With this embodiment, a much larger quantity of liquid can be placed in the reservoir on filling. In effect, at each stroke of the pump, the vent hole 66 is placed in communication with the atmosphere, thereby allowing air to enter the reservoir to cancel out the slight negative pressure created by the previous actuation.

In operation, when the user presses the pushbutton and therefore the piston 3, the pressure in the dosing chamber 19 increases until the outlet valve operates and allows product to move through to the passage 30.

The calibration of the outlet valve is set by appropriate selection of the materials and dimensions of the contact zone between the pintle 52 and the internal aperture 32 of the passage 30, so that it is able to open once the inlet valve is closed. Preferably, the contact zone between the pintle 52 and the edge 32 is circular and its diameter is less than the internal diameter of the bore 20 in the body 2, i.e. the diameter of the stem.

Figure 7:
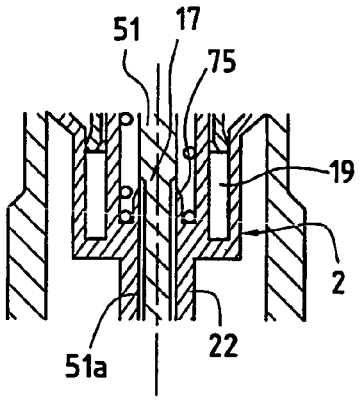
FIG. 7 is a detail view illustrating a variant of the inlet valve.

With reference to the variant in FIG. 7 which essentially shows the bottom of the dosing chamber 19, it is to be noted that the suction tube 22 which communicates with the dosing chamber projects into the latter and has a reduced thickness in proximity to its free end 75, and the part which projects into the dosing chamber engages with the grooved stem 51 to constitute the inlet valve 17. The fact that the profile of the wall is thinner and more particularly tapered towards its end increases the radial elasticity of the end of the suction tube; which makes it possible to obtain a sliding fit between the reduced thickness zone and the stem capable of enhancing the leaktightness with the non-grooved surface of said part forming the stem and therefore increasing the leaktightness of the inlet valve.

Figure 8:
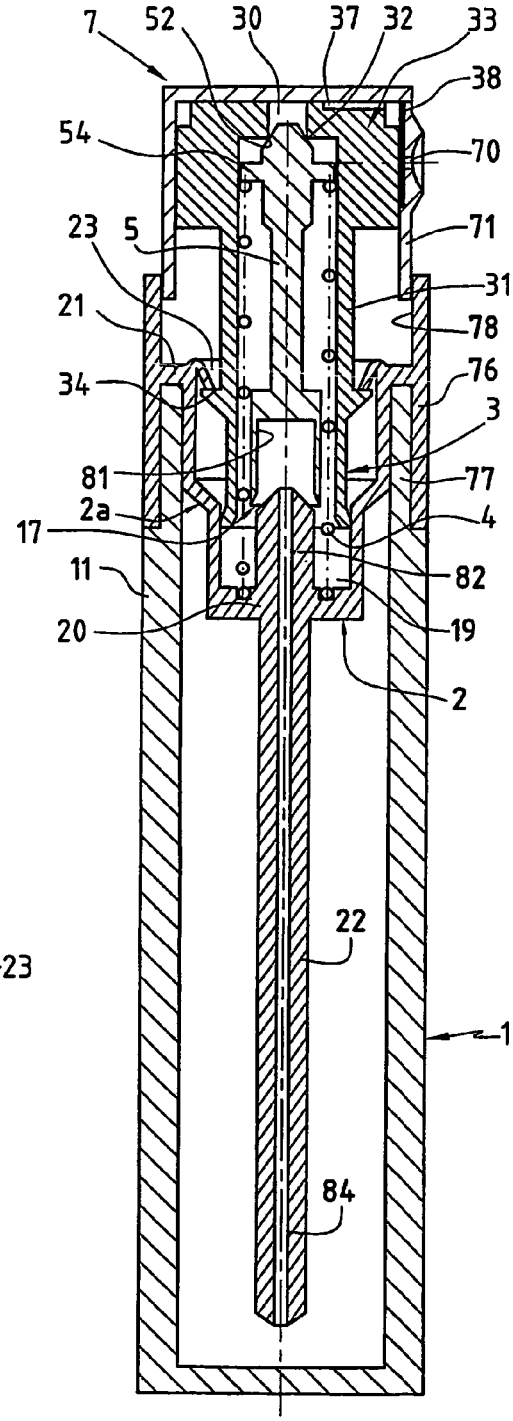
FIG. 8 illustrates a further variant of the spray.

In the variant illustrated in FIG. 8, wherein the elements similar to those of the previous embodiment have the same numbered references and will not be described anew, the pump body 2*a* incorporates an outer skirt 76 enveloping an end portion 77 of said reservoir 1 which includes said nozzle, This outer cylindrical skirt extends axially beyond said nozzle to form a sort of receptacle 78 in which the cylindrical lateral skirt 71 of the head 7 slides.

Figure 9:
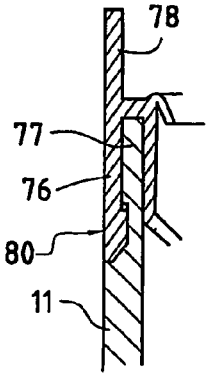
FIG. 9 is a detail view illustrating a variant of the assembly of the pump body on the reservoir nozzle.

In the variant illustrated in FIG. 9, snap-on attachment means 80 are defined between the skirt and said end portion of said reservoir. This further improves the assembly of the pump body and renders it non-detachable, To improve the aesthetic appearance of the device, it is preferable for the reservoir 1 and the outer skirt 76 of the pump body to be axially continuous relative to each other, with no continuity element on the outside. To this end, the wall of said end portion 77 of the reservoir is made thinner so as to define externally an annular setback of radial thickness substantially equal to the thickness of said skirt 76. The embodiment in FIG. 8 also differs from the previous embodiments by the structure of the inlet valve. In this variant, the end of the suction tube 22 communicating with the dosing chamber 19 projects into the latter, while said other end of said obturator 5 is shaped like a bell 81, in this instance having a cylindrical inner wall capable of covering the end portion 82 projecting into the chamber 19 and itself including a cylindrical part surmounted by a tapering part. The diameters are designed to allow the inner wall of the bell to slide in a leaktight manner along the external surface of said end portion. This assembly thus constitutes the inlet valve. This embodiment has several advantages. Firstly, the common obturator is easier to manufacture; it is notably shorter and the bell is more easily fitted on assembly. Furthermore, it presents a larger working surface for opening of the outlet valve and closure of the inlet valve. In other words, all things being equal, less force needs to be applied to the pushbutton to open the outlet valve and create the spray.

In addition, as shown, the suction tube 22 which is no longer traversed lengthwise by a stem has an axial hole 84 of very small diameter, which facilitates priming of the pump by capillary action.

Figure 10:
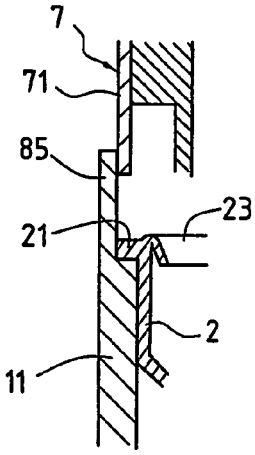
FIG. 10 is a detail view similar to that in FIG. 9 illustrating a further variant.

In the variant illustrated in FIG. 10, the pump body does not form the receptacle in which the lateral skirt 71 slides. The assembly of the pump body conforms to the embodiment illustrated in FIG. 1. However, the reservoir 11 extends beyond the pump body by a thin cylindrical section of wall 85, which forms the receptacle in which the lateral skirt 71 of the head 7 slides, Of course, all of the characteristics particular to the embodiments in FIGS. 8 to 10 can be adapted to the embodiments previously described.

Figure 11:
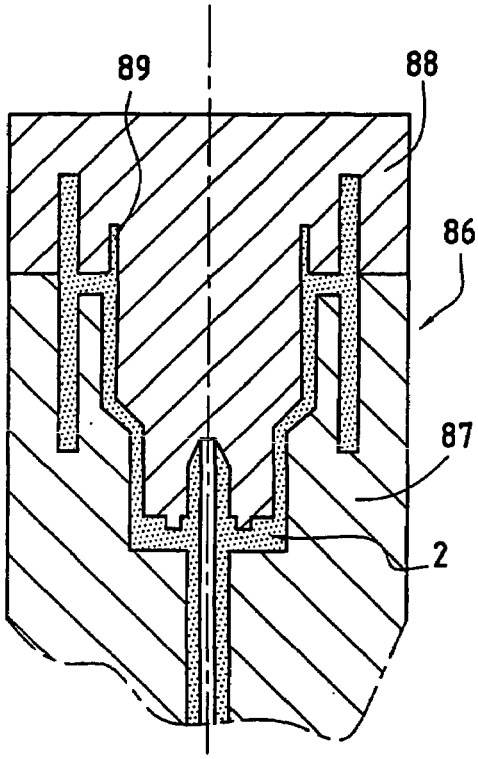
FIGS. 11 to 13 illustrate the successive steps in moulding the pump body and the lip return process.
Figure 12:
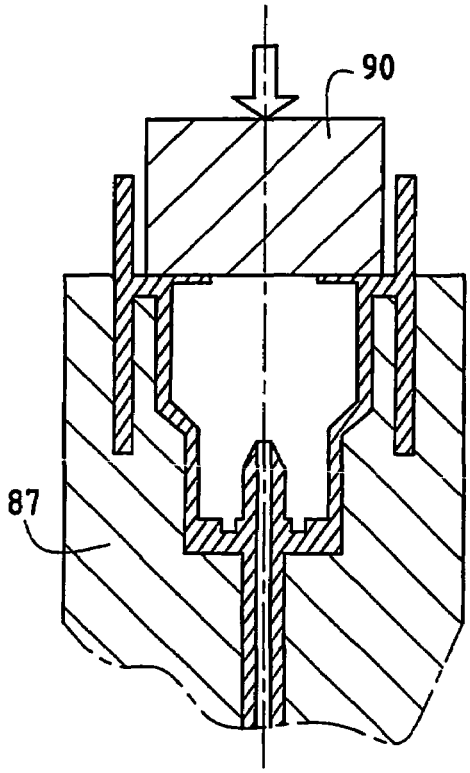
Figure 13:
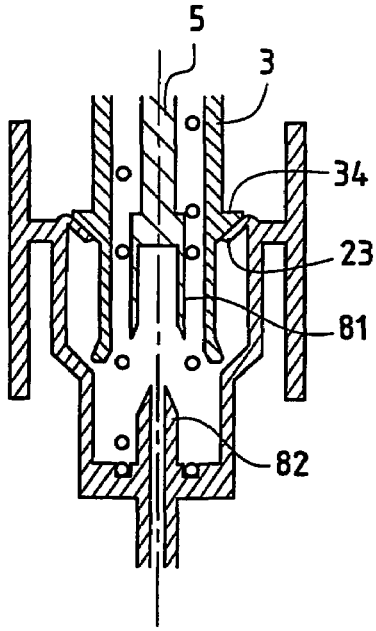

The manufacture by moulding of the pump body 2 per the embodiment in FIG. 8 will now be described in reference to FIGS. 11 to 13. FIG. 11 shows a diagrammatic cross-section of a mould 86 formed in two parts 87, 88 engaged together to define between them a cavity having the shape of said pump body 2. It will be noted that, during the moulding phase, the part which will form the returned lip is moulded in the form of a cylindrical crown 89 (possibly segmented) thereby facilitating stress-free demoulding. During a second stage illustrated in FIG. 12, the cylindrical crown 89 is folded through 900 using a tool 90, which initiates formation of the lip 23. At a later stage (FIG. 13) when the piston is inserted, the tapered part of the annular stop 34 of the piston completes the inward return of the lip towards the pump body. This embodiment is advantageous but, as previously indicated, it is also perfectly possible to mould the pump body with the lip already returned, in which case the pump body is demoulded by force. The lip is extended momentarily as the mould is opened before reverting substantially to its moulding position by virtue of its inherent elasticity.

What is claimed is:

1. Liquid product dispenser including a reservoir incorporating a nozzle and a pump mounted in said nozzle, said pump including:

a pump body housing a piston which slides in a leaktight manner in the pump body so as to define a liquid dosing chamber in conjunction with the pump body, an inlet valve establishing communication between said dosing chamber and the reservoir, an outlet valve establishing communication between said dosing chamber and dispensing means, a spring moving said piston to a released position in which said dosing chamber is at a maximum volume of said dosing chamber, characterized in that said pump body includes an outer portion forming a plug ensuring a leaktight seal between the pump body and said nozzle, and in that said pump body includes an inwardly extending annular projection, obtained by molding, said piston incorporating an annular stop cooperating with said annular projection to define said released position, under the action of said spring, and characterized in that said inlet and outlet valves respectively include a common obturator which is axially mobile inside the pump body, one end of said obturator forming a pintle which engages with an aperture of an outlet passage formed in the piston so as to constitute said outlet valve, and another end of said common obturator engaging with a suction tube on said pump body so as to constitute said inlet valve.

2. Dispenser according to claim 1, characterized in that said annular projection comprises a flexible lip.

3. Dispenser according to claim 2, characterized in that said lip is returned inwards toward the pump body.

4. Dispenser according to claim 2, characterized in that said annular stop of the piston includes, on one side, a stop face cooperating with said lip and, on another side, a tapered portion participating in return of said lip when said piston is mounted in the pump body.

5. Dispenser according to claim 2, characterized in that said lip is segmented.

6. Dispenser according to claim 2, characterized in that a radial length of said lip is greater than a radial distance separating an internal wall of said pump body and an external wall of said piston, in proximity to said lip.

7. Dispenser according to claim 6, characterized in that the wall of said pump body has no vent aperture.

8. Dispenser according to claim 7, characterized in that a quantity of liquid placed in the reservoir on filling is notably less than a capacity of said reservoir.

9. Dispenser according to claim 1, characterized in that said pump body incorporates an outer skirt enveloping an end portion of said reservoir which includes said nozzle.

10. Dispenser according to claim 9, characterized in that snap-on attachment means are defined between the skirt and said end portion of said reservoir.

11. Dispenser according to claim 9, characterized in that a wall of said end portion of the reservoir is made thinner so as to define externally an annular setback of radial thickness substantially equal to a thickness of said skirt.

12. Dispenser according to claim 1, characterized in that said obturator includes a part forming a stem sliding lengthwise in said suction tube, in that sections of said suction tube and of said part forming the stem are adapted to slide in a leaktight manner in proximity to an end of the suction tube which communicates with the dosing chamber, and in that at least one groove is fashioned lengthwise along said part forming the stem, enabling passage of liquid in an inlet phase.

13. Dispenser according to claim 12, characterized in that the end of the suction tube communicating with the dosing chamber projects into the dosing chamber and has a reduced thickness increasing its radial elasticity, to improve the leak-tight contact with a non-grooved surface of said part forming the stem.

14. Dispenser according to claim 1, characterized in that said end of said obturator engaging with said suction tube is formed in the shape of a bell capable of capping an end portion of said suction tube projecting into a bottom of said dosing chamber and capable of sliding in a leaktight manner along an external surface of the end portion of said suction tube.

15. Dispenser according to claim 14, characterized in that said suction tube has an axial hole of very small diameter, which facilitates priming of the pump by capillary action.

16. Dispenser according to claim 1, characterized in that a vent hole is formed in a wall of the pump body and emerges in said dosing chamber in immediate proximity to an inner edge of said piston when said piston is in said released position.

17. Dispenser according to claim 6, characterized in that a vent hole is formed in the wall of the pump body and emerges in said dosing chamber in immediate proximity to an inner edge of said piston when said piston is in said released position.

18. Dispenser according to claim 1, characterized in that a wall of said pump body has no vent aperture.

19. Dispenser according to claim 18, characterized in that a quantity of liquid placed in the reservoir on filling is notably less than a capacity of said reservoir.

* * * * *